United States Patent [19]

Lucas et al.

[11] 4,199,752

[45] Apr. 22, 1980

[54] AUDIBLE SIGNAL DEVICE

[75] Inventors: John R. Lucas, East Norwalk; Sung C. Lee, Bridgeport, both of Conn.

[73] Assignee: Sonetronic Engineering, Inc., Dover, Del.

[21] Appl. No.: 899,538

[22] Filed: Apr. 24, 1978

[51] Int. Cl.[2] ..... G10K 9/12

[52] U.S. Cl. ..... 340/388; 340/392; 340/402

[58] Field of Search ..... 340/388, 392, 402, 384 E, 340/400

[56] References Cited

U.S. PATENT DOCUMENTS

| | | | |
|---|---|---|---|
| 2,561,355 | 7/1951 | Fish | 340/388 X |
| 2,722,681 | 11/1955 | Hersh | 340/388 X |
| 3,298,020 | 1/1967 | Maun | 340/388 X |
| 3,345,525 | 10/1967 | MacBlane | 340/388 X |
| 3,516,088 | 6/1970 | Allport | 340/388 X |
| 3,518,667 | 6/1970 | Hanna | 340/388 X |
| 3,522,601 | 8/1970 | Dolter | 340/388 X |
| 3,525,992 | 8/1970 | West | 340/388 X |
| 3,530,463 | 9/1970 | Spadini | 340/388 X |
| 3,550,118 | 12/1970 | Jenkins | 340/388 X |
| 3,653,039 | 3/1972 | Hoare | 340/388 X |
| 3,656,155 | 4/1972 | Parkes | 340/388 X |
| 3,784,944 | 1/1974 | Schantz | 340/388 X |
| 4,050,066 | 9/1977 | Yanagisawa | 340/388 X |
| 4,065,733 | 12/1977 | Shigemori | 340/388 X |
| 4,097,861 | 6/1978 | Pariza | 340/388 X |

*Primary Examiner*—Harold I. Pitts

*Attorney, Agent, or Firm*—Parmelee, Johnson, Bollinger & Bramblett

[57] ABSTRACT

An improved electromagnetic audible signal device has a coil and an associated magnetic core. A flexible striker arm carrying a movable magnetic contact is positioned above the core. A multiconvoluted diaphragm is located above the movable contact and the striker arm. The contact periodically impacts against this diaphragm generating an audible signal. The invention includes a spring and screw arrangement for linearly adjusting the gap between the core and striker arm. The same spring also serves to restore vibrational mechanical energy to the system which would normally be lost to the housing.

22 Claims, 9 Drawing Figures

Fig. 1.
(PRIOR ART)
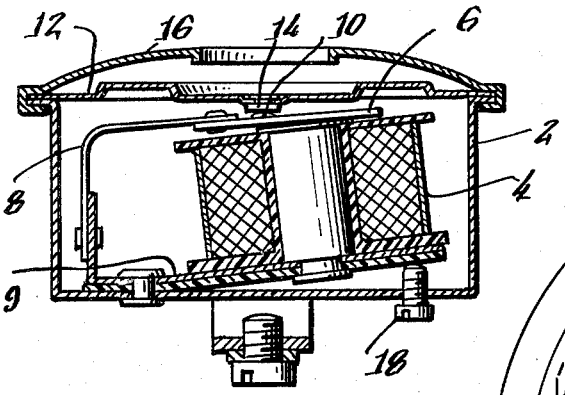
Fig. 2.
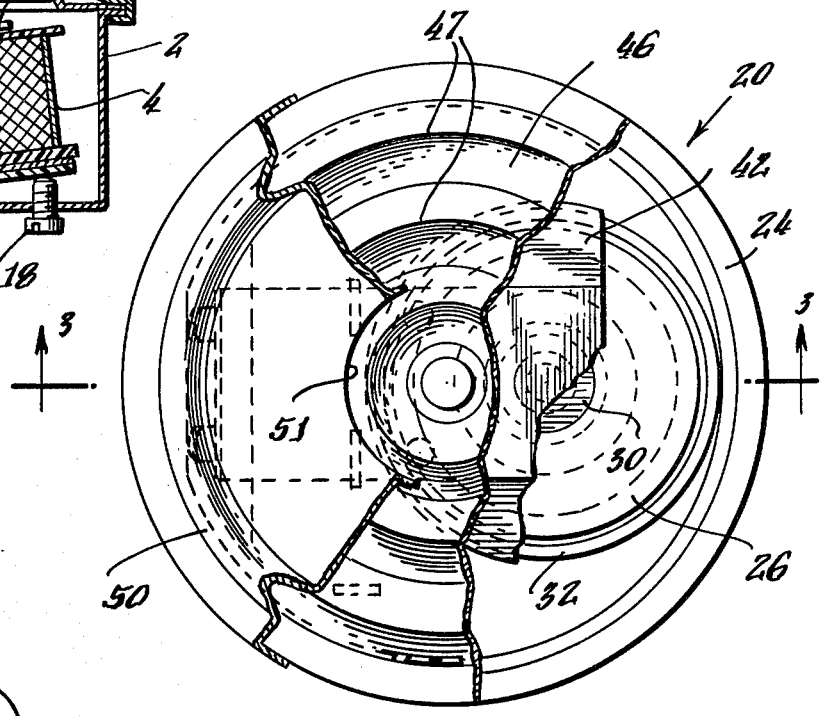
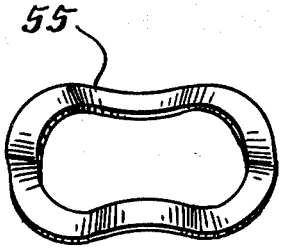
Fig. 4.
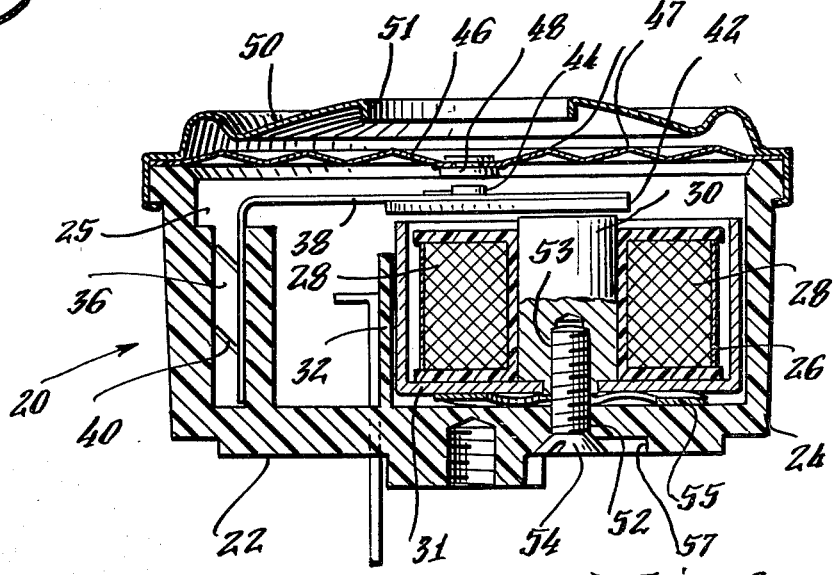
Fig. 3.

Fig. 5.
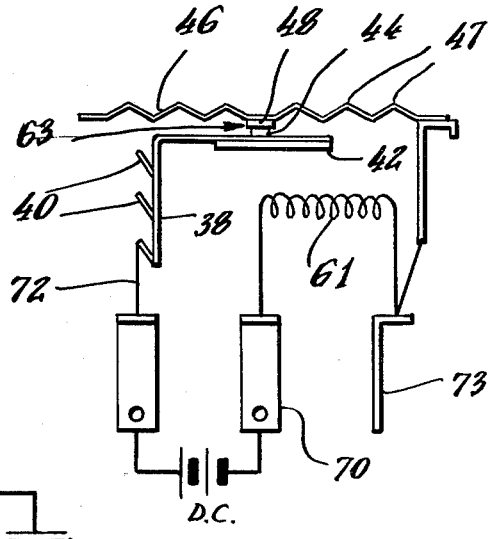
Fig. 6.
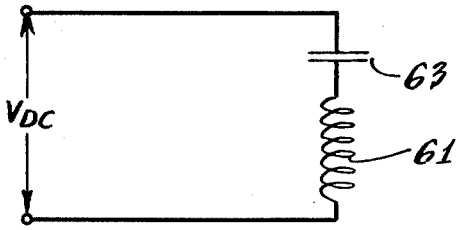
Fig. 7.
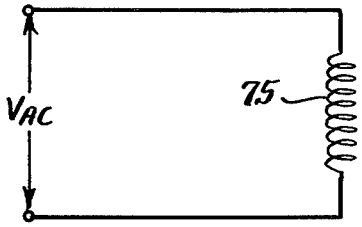
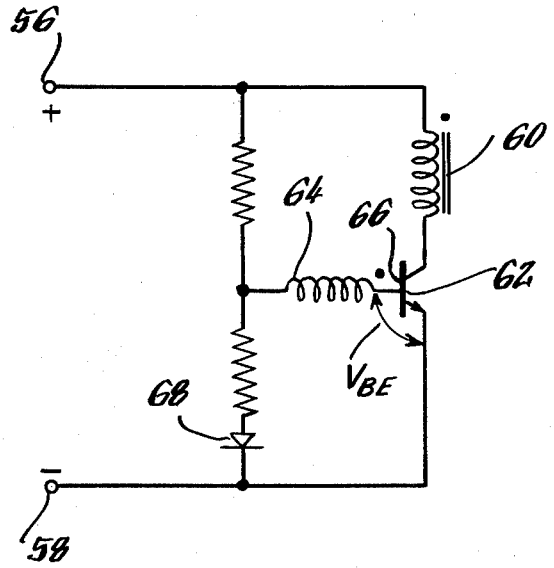
Fig. 9
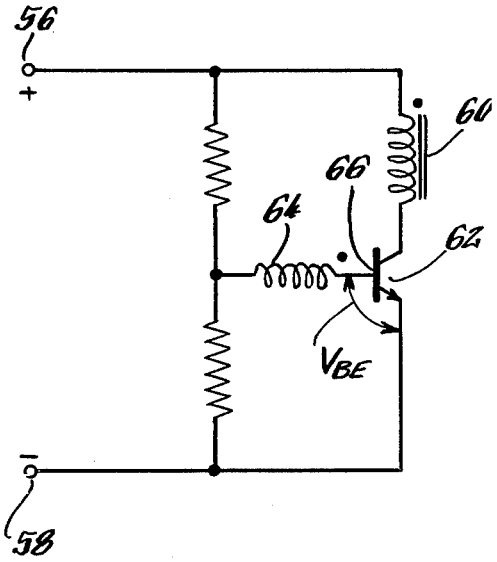
Fig. 8.

AUDIBLE SIGNAL DEVICE

FIELD OF THE INVENTION

The present invention relates to an audible signal device having an electromagnetic assembly, an associated movable armature, and a diaphragm; and more specifically to an improved audible signal device having means for linearly adjusting the position of the assembly relative to the position of the movable armature.

BACKGROUND OF THE INVENTION

Electromagnetic audible signal devices, commonly referred to as buzzers, or horns, are known to the art. Examples of such devices are generally disclosed in U.S. Pat. Nos. 3,784,944 (Schantz, et al), 3,653,039 (Hoare) and 3,656,155 (Parkes).

The typical prior art electromagnetic horn includes an electromagnetic assembly (including a coil and an associated core) and a movable spring-like armature positioned thereabove. The assembly and the armature are housed in a single container having a diaphragm across its top. The diaphragm and the armature carry cooperating electrical contacts which are in series, electrically, with the coil.

Operation of the horn is conventional. When the coil is energized, its core magnetically attracts the armature. As the armature moves toward the core, the contacts open, breaking the circuit to the coil. This releases the armature which resiliently returns, its contact impacting on the diaphragm contact and reconnecting the circuit causing the cycle to repeat. The repeated impacts produce the desired audible signal.

The intensity, pitch, and quality of the tone produced by the device depend on many different factors including the type of material from which the diaphragm is made, the shape of the diaphragm, the shape of the armature, the resiliency of the armature, and the distance between the armature and the magnetic assembly.

With the exception of the distance between the armature and the magnetic core, all of the aforementioned factors are normally predetermined by the design of the device and can be adjusted or varied only with difficulty. However, the prior art devices generally include means for factory adjustment of the gap between the magnetic assembly and the armature.

The reason the distance between the armature and the magnetic assembly affects the intensity of the noise produced by the horn is that the more the armature is bent towards the core, the greater is the resilient force stored therein and the greater is its impact against the diaphragm when released.

The means provided by the prior art for adjusting the distance between the armature and the core include a rotatable screw received by a threaded opening in the bottom of the housing below one side of the coil. When the screw is turned it rises, and lifts one side of the magnetic assembly. Because the other side remains stationary, the assembly tilts, thus decreasing the gap between the armature and the upwardly inclined portion of the magnetic core.

This approach is not completely satisfactory for many reasons. Because the coil is tilted when adjusted, its magnetic force is not utilized efficiently. It is difficult to make a precise gap adjustment since there is no uniform distance between the armature and the core. The slanting magnetic core subjects the system to misalignment and loss of magnetic and mechanical efficiency.

Another disadvantage of the prior art approach is dissipation of the magnetic field of the energized coil because it is not isolated from the other components of the horn. Also, the known devices do not provide means for restoring mechanical energy transferred to the housing back into the vibrating system.

Furthermore, the magnetic efficiency of the prior art horns is diminished because the conducting means through which the magnetic field is applied to the armature includes the resilient armature support means, thereby increasing the path traveled by the field.

It is a primary object of the present invention to provide an improved audible signal device having simple and economical means for linearly adjusting the gap between the magnetic assembly and the armature such that the top of the coil and the armature always remain in substantially parallel relationship.

SUMMARY OF THE INVENTION

The present invention provides an improved audible signal device or horn of the type having an electromagnetic core and coil for magnetically driving a resiliently mounted armature. The armature periodically strikes an acoustical diaphragm to produce an audible signal. Means are provided to energize and deenergize the magnetic core and coil. The invention includes means for supporting the core and coil in a predetermined alignment with the armature and means for selectively adjusting the position of the core and coil while retaining the predetermined alignment with the armature.

In operation, the magnetic field of the energized coil attracts the armature towards the core. When the coil is deenergized, a resilient spring propels the armature against the diaphragm. Repetition of this cycle produces an audible signal.

The means provided to linearly adjust the gap between the armature and the magnetic assembly include a threaded bore in the magnetic core carrying an adjustment screw. A constant uniform force is exerted on the magnetic assembly by means for resiliently supporting the assembly. By turning the screw, the magnetic assembly is movable both upwardly and downwardly. Because the adjusting screw is received by the center of the assembly and because the uniform resilient force is constantly applied to the assembly, the armature and the top of the assembly are always parallel to each other.

Means for electrically energizing the horn include a transistor for driving a primary magnetic coil and a secondary induced voltage for driving the transistor. Alternatively, a single coil can be connected across a D.C. source and conventional contact means can be used to break and reconnect this circuit. Additionally, a single coil can be connected across an A.C. source to energize and de-energize the coil.

BRIEF DESCRIPTION OF THE DRAWINGS

FIG. 1 is a cross sectional side view of a typical prior art electromagnetic horn;

FIG. 2 is a top plan view, partially broken away, of an embodiment of an electromagnetic audible signal device in accordance with the present invention;

FIG. 3 is a cross sectional side view of the embodiment of the invention illustrated in FIG. 2 as viewed along line 3—3 of FIG. 2;

FIG. 4 is a perspective view of a three point support wave spring as used in the present invention;

FIG. 5 is a schematic view of an electrical energization circuit utilizing contacts.

FIG. 6 is a diagram of the circuit of FIG. 5.

FIG. 7 is a diagram of an electrical energization circuit utilizing an A.C. source and no contact connections.

FIGS. 8 and 9 are diagrams of electrical energization circuits utilizing a double coil winding.

PRIOR ART

FIG. 1 of the drawing shows a typical prior art electromagnetic horn including a housing 2, a magnetic assembly 4, an armature 6, an armature spring 8, an armature contact 10, a diaphragm 12, a diaphragm contact 14, a cover 16 and an adjusting screw 18. Magnetic conducting strip 9 joins with the bottom of armature spring 8 for applying the magnetic field of the coil to the armature. Conventional means are provided to energize and de-energize the magnetic assembly such that the armature contact periodicaly strikes the diaphragm contact to produce an audible signal.

The adjusting screw lifts the right side of the magnetic assembly causing it to tilt. The tilted magnetic assembly is out of alignment with both the armature and the horizontal diaphragm thereabove.

DESCRIPTION OF THE PREFERRED EMBODIMENT

A. Structure of the Preferred Embodiment

Referring now to FIGS. 2, 3 and 4, an audible signal device in accordance with the present invention is illustrated. It includes a cylindrically shaped main housing 20 made of plastic having a base portion 22 and sidewall 24. A magnetic assembly 26, comprised of coils 28 and a magnetic core 30, is sandwiched between sidewall 24 and an inner wall 32 in a well defined by these walls and the base. The main housing defines a slot 36 adapted to receive one end of an "L" shaped armature spring 38. Lances 40 hold this armature spring securely within the slot.

Because the housing is plastic, it can be economically mass produced by casting. Thus, the walls defining slot 36 and the well defined between sidewall 24 and inner wall 32 for receiving the magnetic assembly are provided integral with the housing at its time of manufacture. Separate steps for erecting walls to define the slot and the well are eliminated and no additional components are required to mount these walls on the base.

The other end of the "L" shaped armature spring, which extends horizontally across the main housing above the top surface of core 30 and parallel thereto, carries armature 42 on its lower surface and armature contact 44 on its upper surface.

Magnetic assembly 26 is held in cup 31 which is formed of a magnetic conducting material. The base and walls of the cup conduct the magnetic field of the coil to the armature. The path traveled by the field is considerably shorter than that of the prior art (see magnetic strip 9 of FIG. 1), thereby increasing the magnetic efficiency of the present invention.

Multiconvoluted diaphragm 46 is supported by the top of sidewall 24. Diaphragm contact 48, carried on the center of the lower surface of the diaphragm, is in direct alignment with the armature contact 44. The periphery of diaphragm 46 is crimped to the top of sidewall 24 by the periphery of cover 50. Cover 50 arcs upwardly to avoid interference with the vibrating diaphragm when the diaphragm contact is struck by the armature contact (to be described in more detail below). Cover 50 has an opening 51 in its center for avoiding interference with the transmission of audible signals produced by the vibrating diaphragm.

The upper portion 25 of sidewall 24 is recessed outwardly for maximizing the amount of exposed surface area of diaphragm 46 for further increasing the efficiency of the horn and improving the tone of the signal produced.

The horn provides a spring and screw arrangement for linearly adjusting the position of the magnetic assembly relative to the housing. A countersunk hole 52 through the base of the main housing receives a flat headed adjusting screw 54. The head of the screw, which is accessible from the exterior of the main housing, is wider than the narrow portion of the hole and is thus retained outside the housing. The countersunk hole tends to hold the screw upright. Magnetic core 30 has a threaded bore 53 positioned to receive a portion of the adjusting screw entering the main housing through hole 52.

The base of the main housing defines at least one narrow "lock in" slot 57 communicating with hole 52. Once the adjusting screw is in its desired position, liquified wax is poured into slot 57. The wax, which subsequently solidifies, securely locks the adjusting screw in its desired position.

A three point supporting wave spring 55 is positioned below magnetic assembly 26 and exerts a constant upward force on the lower surface thereof. This wave spring is shown fully by FIG. 4. Its support points are spaced equal distances apart from each other, and its shape corresponds to the shape of the lower surface of the magnetic assembly. Thus, the force exerted by the wave spring is uniformly applied to the entire magnetic assembly. In the alternative, three separate coil springs can be used to provide the three point resilient support for the magnetic assembly. Although the preferred embodiment places the resilient supports under the magnetic assembly, it is also possible to resiliently support this assembly from above. In this situation, the support will exert a constant downward force on the top of the assembly.

The described screw and spring arrangement allows two way linear adjustment of the position of the magnetic assembly relative to the armature. Turning the screw in one direction raises the magnetic assembly because the spring is allowed to expand upwardly. Turning the screw in the other direction lowers the magnetic assembly and the spring is further compressed. The magnetic assembly moves linearly and is always horizontal because the spring always exerts a uniform force on the entire lower surface of the assembly.

The magnetic assembly is securely maintained in its adjusted position by the interaction between the screw retained in the bore and the upward force of the spring on the assembly. The upward force of the wave spring prevents the assembly from sliding down the screw, and the relationship between the screw and the threaded bore prevents the spring from forcing the magnetic assembly off the top of the screw.

The importance of this adjustment feature is that the intensity, pitch, and quality of the tone of the audible signal can be controlled. By adjusting the gap between the magnetic assembly and the armature, the resilient force with which the armature contact strikes the diaphragm contact is varied. A relatively large gap will bend the armature spring to a greater degree, thereby causing it to impact against the diaphragm with greater force.

In addition to providing means for linearly adjusting the gap, using a wave spring to support the magnetic assembly tends to restore energy to the vibrating mechanical system that would normally be lost to the housing.

FIGS. 8 and 9 illustrate electrical means for energizing and de-energizing the electromagnetic assembly of the horn without contacts.

Referring to FIG. 8, an electrical energy source (not shown) is provided across terminals 56 and 58. A primary coil 60 is connected in series with the collector-emitter path of a transistor 62 across terminals 56 and 58. A secondary coil 64, which is inductively coupled to the primary coil 60, is electrically connected to the base 66 of the transistor for establishing a bias voltage across the base and emitter of the transistor. The induced voltage of the secondary coil is opposite in polarity to the base-emitter voltage of the transistor.

FIG. 9 is a slightly modified embodiment of the circuit illustrated in FIG. 8. It includes a diode 68 in parallel relationship to transistor 62.

FIGS. 5 and 6 illustrate means for electrically connecting the voltage of a single coil 61 to the diaphragm 46. When the armature contact 44 contacts the diaphragm contact 48, the circuit is closed and the coil is energized to attract armature 42.

FIG. 7 illustrates another means for energizing and de-energizing the magnetic assembly.

B. OPERATION OF THE PREFERRED EMBODIMENT

The operation of the preferred embodiment will now be discussed with particular reference being made to FIGS. 3, 5, 6, 7, 8 and 9.

Referring to FIGS. 3, 8 and 9, a D.C. electrical source (not shown) energizes a primary winding 60 of coil 28. The resultant magnetic field attracts armature 42 towards magnetic core 30. The magnetic field of the primary winding induces a voltage across a secondary winding 64 which is inductively coupled to the primary winding.

Transistor 62 drives primary coil 60, which is in series relationship with the collector-emitter path of the transistor. Initially, the transistor is in a conducting state and the primary coil is energized by the electrical source. The energized primary winding induces a voltage across the secondary winding. This induced voltage is of polarity opposite that of the base-emitter voltage of the transistor and establishes a bias across the base and emitter.

As the induced secondary voltage increases, the base-emitter voltage of the transistor decreases until its value falls below a predetermined cut off level, at which point the transistor switches into its nonconducting state, thus de-energizing the primary coil. The attracted armature is released and the armature spring thrusts it towards the diaphragm. The armature contact strikes the diaphragm contact, causing the diaphragm to vibrate, and producing an audible signal.

Once the transistor is cut off, the value of the base-emitter voltage increases above its predetermined cut off level and the transistor switches into a conducting state. The primary coil is re-energized, the armature is attracted towards the magnetic core, and the cycle repeats. Rapid repetition of this cycle keeps the diaphragm continually vibrating thereby producing the desired audible signal.

FIG. 9 of the drawing illustrates a slight modification of the circuit of FIG. 8 by including a diode 68 for compensating for the effect which a change in ambient temperature has on the base-emitter voltage of the transistor. The use of a diode for this purpose is known and more fully explained in U.S. Pat. No. 4,065,733.

FIGS. 5, 6 and 7 illustrate alternate means for energizing and de-energizing the magnetic assembly.

Referring to FIGS. 5 and 6, a single coil 61 and electrical contacts 63 (consisting of diaphragm contact 48 and armature contact 44) are connected in series across a D.C. source by electrical connecting means 70 and 72. When armature contact 44 and diaphragm contact 48 touch, contact 63 is closed, and the circuit is completed. Coil 61 is energized and attracts armature 42. This opens contact 63, breaking the circuit and de-energizing the coil. The armature resiliently strikes the diaphragm and reconnects the circuit, re-energizing the coil. Rapid repetition of this cycle produces the desired sound.

Means for suppressing electrical arcing 73, including an RC circuit (not shown), is illustrating in FIG. 5. This feature is optional to the invention and may be selectively connected to the coil if desired.

Referring to FIG. 7, another means for energizing and de-energizing the magnetic assembly is shown. A single coil 75 is connected across an A.C. electrical source. This circuit advantageously utilizes only a single coil and no electrical contacts.

The preferred embodiment includes other features tending to maximize the efficiency of its operation. For example, its efficiency is enhanced by using a nonmagnetic housing which minimizes magnetic leakage from the system.

Also, cover 50 is arced upwardly to avoid interfering with the vibrating diaphragm and to increase the acoustic efficiency. The opening 51 in the center of the cover minimizes the interference of the cover with the transmission of the audible signals produced.

Furthermore, diaphragm 46 carries a series of concentric convolutions (or ripples) 47 for optimizing air movement relative to the diaphragm to improve the harmonics of the audible signal generated.

Because the housing and the inner walls carried therein are cast from plastic, the present invention eliminates the use of unnecessary connecting or mounting elements. The invention is economical to produce because it requires about 40% fewer components than the typical prior art devices and is thus readily adaptable to mass production manufacture.

It is believed that the many advantages of this invention will now be apparent to those skilled in the art. It will also be apparent that a number of variations and modifications may be made in the described embodiment without departing from the scope and spirit of the invention. Accordingly, the foregoing description is to be construed as illustrative only, rather than limiting, the invention being limited only by the following claims and all equivalents thereto.

What is claimed is:

1. In an electric horn of the type including a housing having a base and sidewall, an acoustical diaphragm mounted on said housing, an electromagnetic coil and core assembly mounted within said housing, a resiliently mounted armature carried by said housing for reciprocating movement between said core and said diaphragm, and means for repetitively energizing and deenergizing said coil, the improvement which comprises:

first means for resiliently supporting said coil and core assembly in predetermined alignment with said base, said first means being centrally positioned in approximate axial alignment with said core and coil assembly and exerting a resilient force on said assembly, second means acting upon said assembly and cooperating with said first means to selectively adjust the position of said assembly within said housing by controlling the effect of the resilient force exerted on said assembly by said first means, said second means being approximately centrally positioned with respect to said core and coil assembly for linearly adjusting the position of said core and coil assembly while substantially retaining said predetermined alignment with said base.

2. An electric horn as claimed in claim 1 wherein said second means acting upon said assembly includes a selectively movable member interconnecting said housing and said assembly.

3. An electric horn as claimed in claim 1 wherein said second means acting upon said assembly includes an adjusting screw interconnecting said housing and said magnetic core.

4. An electric horn as claimed in claim 3 including:

an opening in said housing receiving said adjusting screw, a bore carried on said magnetic core receiving and retaining said adjusting screw therein.

5. An electric horn as claimed in claim 4 wherein said bore is threaded.

6. An electric horn as claimed in claim 1 wherein said housing is nonmagnetic.

7. An electric horn as claimed in claim 6 wherein said electromagnetic assembly is lined with a magnetic conducting material.

8. An electric horn as claimed in claim 1 wherein said diaphragm is convoluted.

9. An electric horn as claimed in claim 1 wherein said first means for resiliently supporting said coil and core assembly includes at least three supporting points.

10. An electric horn as claimed in claim 9 wherein said first means for resiliently supporting said coil and core assembly includes a wave spring.

11. An electric horn as claimed in claim 10 wherein the supporting points of said wave spring are equidistant.

12. An electric horn as claimed in claim 4 wherein said opening in said housing is a countersunk hole wherein the head of said adjusting screw is retained outside of said housing.

13. An electric horn as claimed in claim 1 wherein said means for energizing and de-energizing said electromagnetic coil includes an electrical energy source and a transistor, said transistor connected across said electrical source for driving said coil.

14. An electric horn as claimed in claim 13 wherein said electromagnetic coil includes a primary winding for generating a magnetic field, said primary winding driven by said transistor, and a secondary winding, said secondary winding inductively coupled to said primary winding for inducing a secondary voltage, said secondary voltage having a polarity opposite that of the base-emitter voltage of said transistor, said secondary voltage establishing a bias across the base and emitter of said transistor, whereby said base-emitter voltage drops below a predetermined value and said transistor switches to a nonconducting state.

15. An electric horn as claimed in claim 14 including means for discharging said secondary voltage, whereby said base-emitter voltage increases above said predetermined value and said transistor switches to a conducting state.

16. An electric horn as claimed in claim 1 wherein said means for energizing and de-energizing said electromagnetic coil includes an electrical energy source and an electrical contact in series relationship with said electromagnetic coil.

17. An electric horn as claimed in claim 16 wherein said contact is closed when said armature contacts said diaphragm, and said contact is open when said armature is apart from said diaphragm.

18. An electric horn as claimed in claim 1 wherein said means for energizing and de-energizing said electromagnetic coil includes an A.C. electrical energy source connected across said electromagnetic coil.

19. In an electric horn of the type including a housing having a base and sidewall, an acoustical diaphragm mounted on said housing, an electromagnetic coil and core assembly mounted within said housing, a resiliently mounted armature carried by said housing for reciprocating movement between said core and said diaphragm, and means for repetitively energizing and deenergizing said coil, the improvement which comprises:

a wave spring for resiliently supporting said coil and core assembly and exerting a resilient force thereon, said wave spring being interposed between said base and said assembly and being centrally positioned in approximate axial alignment with said assembly for maintaining said assembly in predetermined alignment with said base; and an adjustment screw received within said core in the approximate center thereof for interconnecting said core and said base, said adjustment screw extending axially through the center of said wave spring for controlling the effect of said resilient force exerted on said assembly by said wave spring to linearly adjust the position of said assembly while substantially retaining said predetermined alignment with said base.

20. An electric horn as claimed in claim 19 wherein said adjustment screw is received and retained within a bore defined in said core.

21. An electric horn as claimed in claim 20 wherein said bore is threaded.

22. An electric horn as claimed in claim 20 wherein said adjustment screw passes through a countersunk hole in said housing, the head of said adjustment screw being wider than the smallest dimension of said countersunk hole so that said head is retained outside of said housing.

* * * * *